US005303516A

United States Patent [19]

Delamare

[11] Patent Number: 5,303,516

[45] Date of Patent: Apr. 19, 1994

[54] INFLATABLE VAULT WHICH CAN BE OPENED OUT AND COLLAPSED

[75] Inventor: Guy R. Delamare, Rueil, France

[73] Assignee: Spironef Industries, Rueil Malmaison, France

[21] Appl. No.: 894,278

[22] Filed: Jun. 4, 1992

[30] Foreign Application Priority Data

Jun. 4, 1991 [FR] France ..... 91 06755

[51] Int. Cl.[5] ..... E04H 15/20

[52] U.S. Cl. ..... 52/2.11; 52/2.18; 52/2.22

[58] Field of Search ..... 52/2.11 OR, 2.13, 2.18, 52/2.22, 2.24, 1

[56] References Cited

U.S. PATENT DOCUMENTS

| | | | |
|---|---|---|---|
| 2,752,928 | 7/1956 | Barker . | |
| 2,830,606 | 4/1958 | Daugherty | 52/2.24 |
| 2,872,933 | 2/1959 | Mackey | 52/2.24 |
| 2,910,994 | 11/1959 | Joy | 52/2.11 |
| 3,816,867 | 6/1974 | Shirzad et al. | 52/2.13 |
| 3,973,363 | 8/1976 | LaPorte . | |
| 4,004,380 | 1/1977 | Kwake | 52/2.24 |
| 4,227,542 | 10/1980 | Bonfilio . | |
| 4,301,626 | 11/1981 | Davis et al. . | |
| 4,317,315 | 3/1982 | LeBlang | 52/2.24 |
| 4,340,626 | 7/1982 | Rudy . | |
| 4,558,543 | 12/1985 | Kitamura et al. | 52/2.11 |

FOREIGN PATENT DOCUMENTS

| | | | |
|---|---|---|---|
| 0085270 | 8/1983 | European Pat. Off. . | |
| 0312429 | 4/1989 | European Pat. Off. . | |
| 1602054 | 11/1970 | France . | |
| 89/02963 | 4/1989 | PCT Int'l Appl. | 52/2.11 |
| 566745 | 9/1975 | Switzerland | 52/2.24 |
| 438761 | 1/1975 | U.S.S.R. | 52/2.24 |
| 1516595 | 10/1989 | U.S.S.R. | 52/2.11 |

*Primary Examiner*—Carl D. Friedman
*Assistant Examiner*—Wynn E. Wood
*Attorney, Agent, or Firm*—Wenderoth, Lind & Ponack

[57] ABSTRACT

A vault is of the multi-lobed double-wall type, including inflatable beams disposed side by side. The vault includes at least one opening-out or folding-up path along which the beams are slidably mounted. Each opening-out or folding-up path traverses the beams in a sealed manner.

21 Claims, 9 Drawing Sheets

INFLATABLE VAULT WHICH CAN BE OPENED OUT AND COLLAPSED

BACKGROUND OF THE INVENTION

The present invention relates to multi-lobed double-wall inflatable vaults, which can be opened outwardly and collapsed by inflating and deflating, respectively.

An inflatable vault generally includes a plurality of longitudinal beams disposed side by side, means for sliding at least one longitudinal end of the beams along at least one opening-out or folding-up path and means for supplying the beams with inflating fluid.

An inflatable vault is known, more particularly, in French Patent Application FR-A-87 14,259 corresponding to U.S. Pat. No. 4,976,074, in which each beam comprises two opposite panels forming flanges, each constituting one of the lobes of an inner or outer wall of the vault, and two lateral panels forming webs of the beam. The means for supplying the beams with inflating fluid are formed by at least one conduit traversing the beams and being extendable in its length, its pulling-out and its retraction being controlled by the opening-out and the collapsing of the vault, respectively.

In such vault, the supply conduit is common to all the beams and communicates with each of the beams via an orifice which can be shut off and controlled by shutting-off means, and the supply conduit traverses in a sealed manner openings made in each of the lateral panels.

The opening-out of such vault poses problems because the opening-out path is located at the end of the beams, which leads to stresses distributed over a small zone of the wall.

SUMMARY OF THE INVENTION

In order to overcome these drawbacks, the object of the present invention is to provide an inflatable vault, the opening-out and folding-up of which are facilitated.

For this purpose, the subject of the present invention is a multi-lobed double-wall inflatable vault which can be opened out and collapsed by inflating and deflating respectively, and comprising:

a plurality of longitudinal beams disposed side by side, means for sliding at least one longitudinal end of the beams along at least one opening-out or folding-up path, means for supplying the beams with inflating fluid, wherein the opening-out or folding-up path traverses the beams in a sealed manner.

According to other characteristics of the invention:

each beam comprises inflatable means for sealing with the opening-out or folding-up path after the vault has been opened outwardly, the opening-out or folding-up path extends longitudinally inside a fluid supply conduit and the sliding means are located between the path and a wall of the conduit, the path consists of an arched metal beam possessing a circular transverse cross-section, the sliding means are located in openings of two adjacent panels of two successive beams, the sliding means comprise runners which are mounted so as to slide along the opening-out or folding-up path, the runners being supported by radial members extending perpendicular to the path and being continued radially by an annular hollow structure coaxial with the path, the outer radial periphery of which is connected to edges of the openings of the adjacent panels in a sealed manner, the hollow structure opening inside the supply conduit and communicating with the interior of one of the successive beams via an orifice which can be shut off, each structure comprises an outer collar and an inner collar forming an annular passage constituting the orifice which can be shut off, and the means for shutting off this orifice are formed by an inflatable and flattenable bladder supported by the inner collar and coming into sealed contact with the outer collar when the bladder is inflated, each hollow structure comprises means for sealed fixing of an extendable wall extending between two successive hollow structures, the extendable wall delimiting the supply conduit and providing continuity thereof, at least one rigid ring is mounted so as to slide along the path between the latter and each extendable wall in such a way that each extendable wall constitutes, after inflating the vault, a bellows of the supply conduit, a plate extends radially towards the outside of the hollow structure and comprises means for sealed fixing of adjacent panels of the beams, a fitting is fixed to one zone of the periphery of the plate and extends to the outside of the vault, the fitting being connected to a member for connection to a carriage mounted so as to slide along a rail arched in parallel with respect to the path, the rail being anchored in the ground, the vault comprises two opening-out or folding-up paths arranged in a parallel manner in the vicinity of the longitudinal ends of the beams, the vault consists of two half-vaults which, by inflating, open out towards one another from the ends of the opening-out or folding-up path or paths and which, by deflating, are folded up towards the ends of the opening-out or folding-up path or paths by moving away from one another, the opening-out or folding-up paths are fixed at their ends to ballastable movable caissons, each path comprises two end portions, each fixed to a caisson, and a removable central portion located between ends portions, the end portions being surrounded by the longitudinal end of the beams of the half-vault in the folded-up state, the ends of the opening-out or folding-up paths are fixed to abutment-shaped structures anchored in the ground, the inflating-fluid supply means are located in a continuation of the supply conduit and of the opening-out or folding-up path, inflatable means being disposed in the annular space between the supply conduit and the path in order to ensure sealing after inflating the vault, each opening-out or folding-up path comprises, in its central portion, a fitting connected to the ground via at least one brace, each opening-out or folding-up path is connected via fittings, located at the end and in the middle of the path, to a caisson extending under the path and having a vertical crescent shape, the upper arched wall of the caissons being parallel to the said paths, an inflatable seal is disposed between the upper wall of each caisson and the ends of the beams located opposite one another, the caisson comprises inflating-fluid supply means, ballasting means and a portion forming an access door under the vault.

BRIEF DESCRIPTION OF THE DRAWINGS

The present invention will be better understood from the detailed description which follows, made by way of example and with reference to the attached drawings, in which.

DETAILED DESCRIPTION OF THE INVENTION

Figure 1:
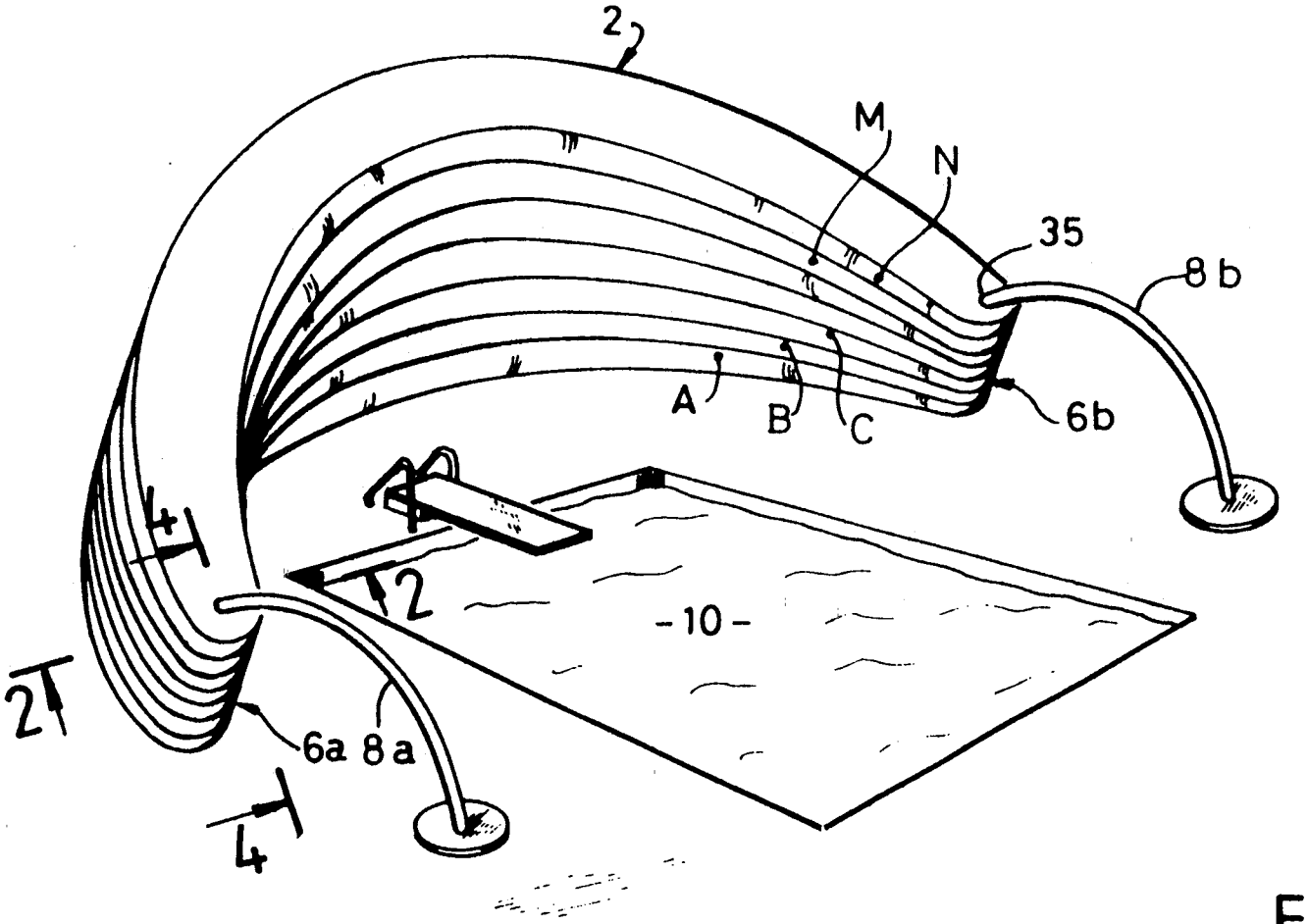
FIG. 1 is a diagrammatic view, in perspective, of a vault according to the present invention.

FIG. 1 shows an inflatable vault 2 consisting of several sealed inflatable beams A, B, C . . . M, N which are disposed side by side in order to form the vault.

A portion of the beams is shown in the inflated state.

At each longitudinal end 6*a*, 6*b* of the beams A, B, C, etc., the beams are mounted so as to slide along an opening-out or folding-up path or path defining guide and support member 8*a*, 8*b* which traverses the flexible walls of the beams as will be described subsequently.

The opening-out or folding-up paths 8*a*, 8*b* each are produced in the form of a tube of circular cross-section which is arched and fixed in the ground in such a manner that, on inflating, the beams A, B, C, etc., cover, partially or totally, a swimming pool 10 for example.

Reference is now made to FIGS. 2 to 5 which show the manner in which a path 8*a* traverses the longitudinal ends of the beams A, B, C, etc.

It will be noted that with the portion of the path 8*a* shown being of relatively small longitudinal size with respect to the length of the path 8*a*, the portion which is shown is substantially straight and of axis X—X.

Figure 2:
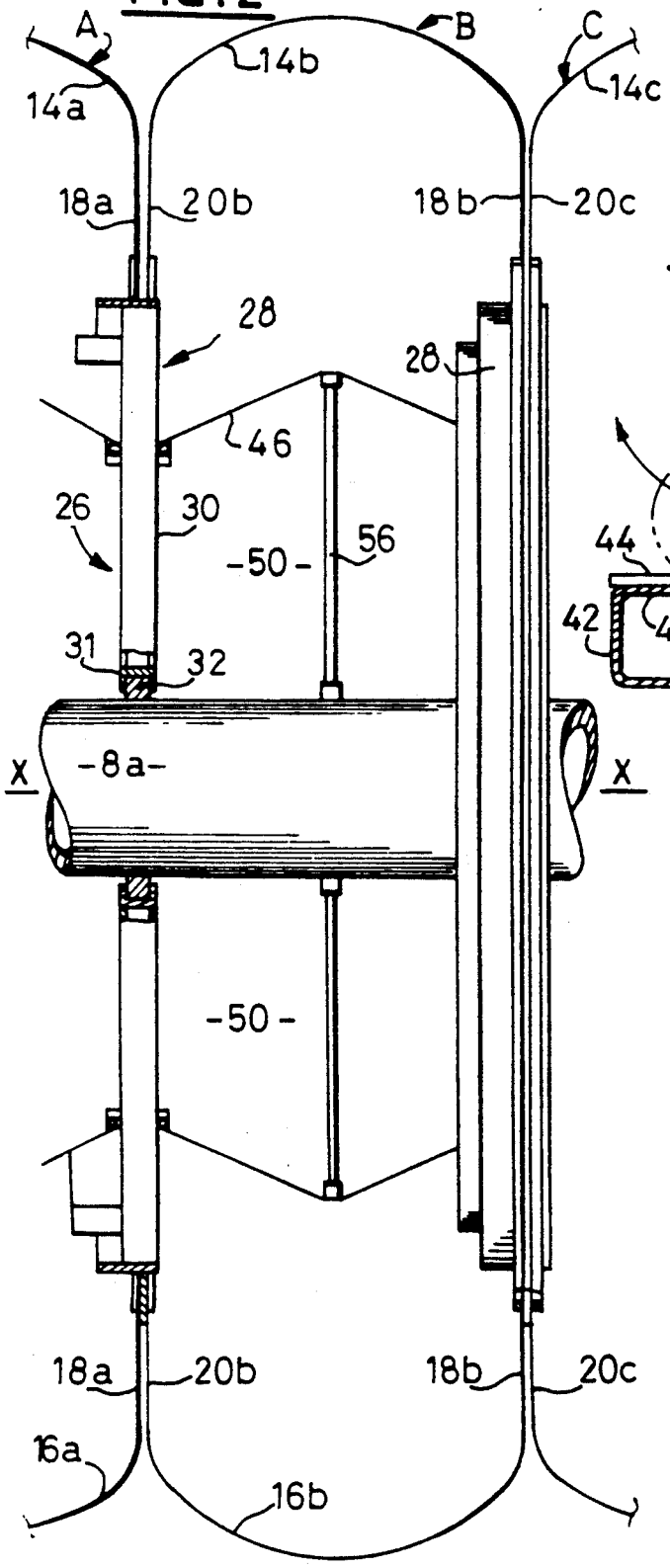
FIG. 2 is a diagrammatic view in partial cross-section along the arrows 2—2 of FIG. 1.

FIG. 2 diagrammatically shows one longitudinal end, in partial cross-section, of a beam B disposed between a beam A and a similar beam C.

Each beam A, B, C, etc., consists of at least one panel, a respective portion 14*a*, 14*b*, 14*c*, etc. of which forms a flange and respective portions 18*a*, 20*b*, 18*b*, 20*c*, etc. of which form webs of the beams.

It will be noted that the portions 18*a*, 20*b* and 18*b*, 20*c*, etc. are intended to be located side by side in order to form partitions for separating the beams A, B, C, etc.

The panels of two adjacent beams are fixed to a plate 52 with the aid of two profile members 22 in which the ends of each panel are held. The profile members 22 are fixed to the plate 52 with the aid of connecting means 24 (FIG. 3).

A circular opening 26 of axis X—X extends through respective portions 18*a*, 20*b*, 18*b*, 20*c*, etc. of the panels of the adjacent beams.

Figure 3:
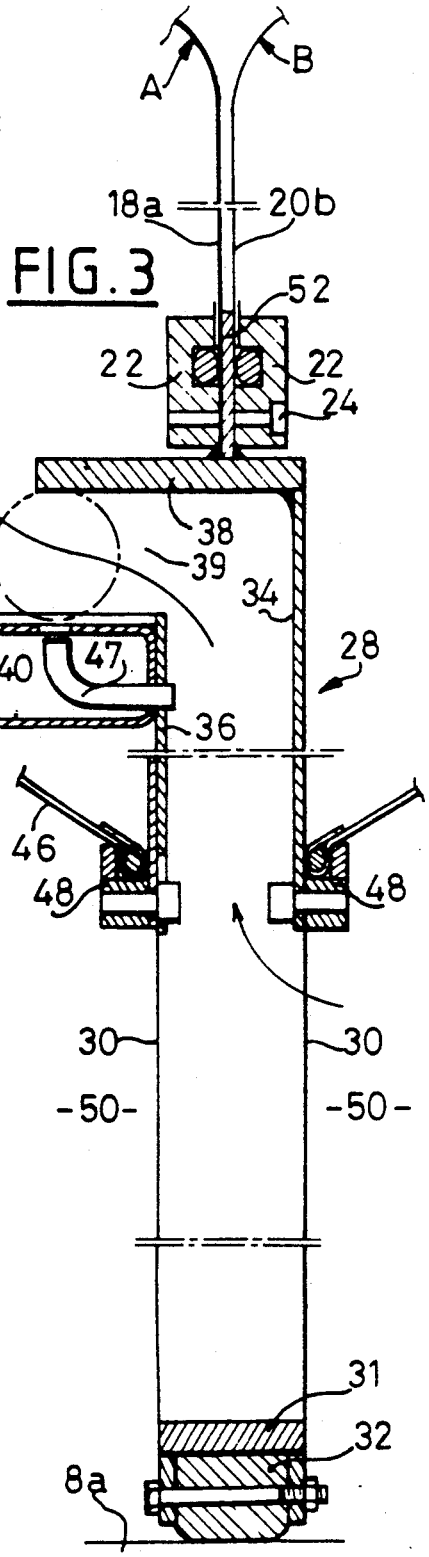
FIG. 3 is a sectional view of a portion of FIG. 2, on a larger scale.
Figure 4:
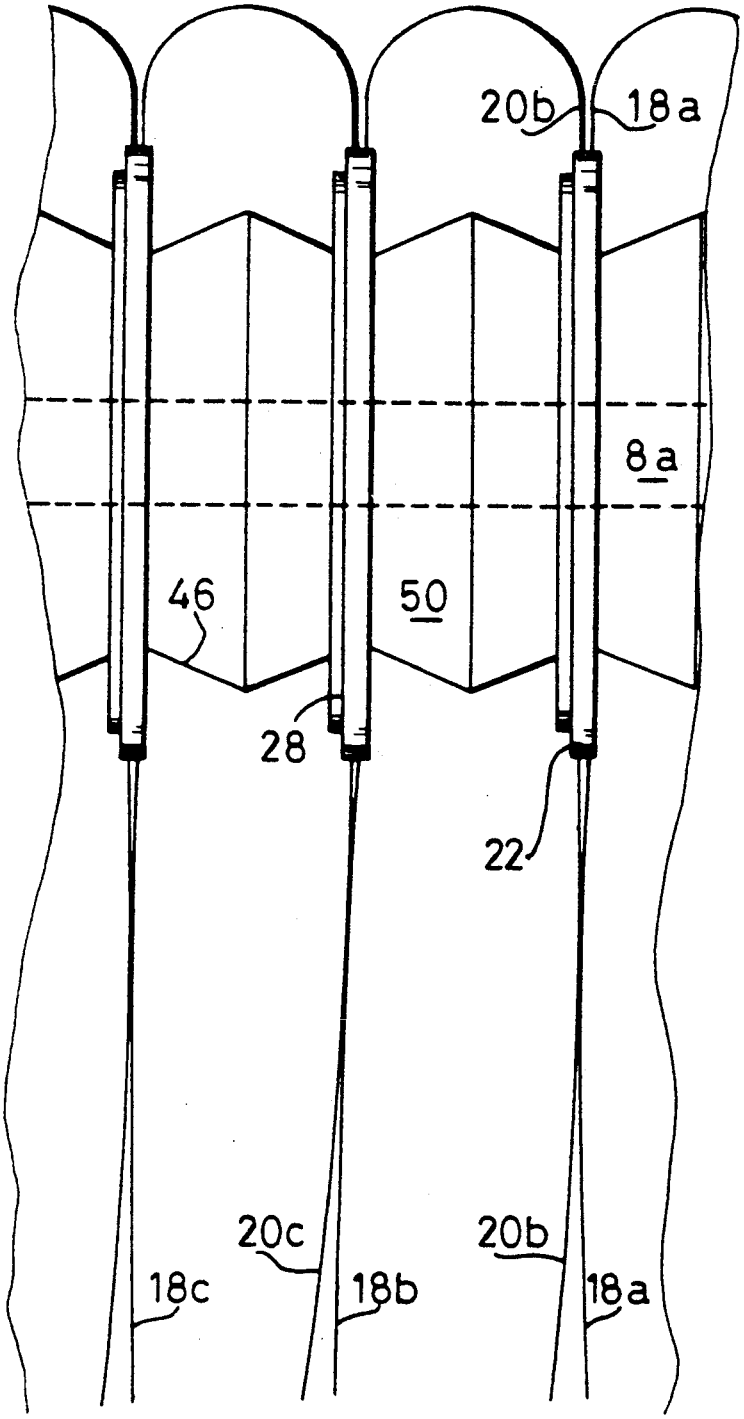
FIG. 4 is a diagrammatic view in partial cross-section along the arrows 4—4 of FIG. 1.

An annular hollow structure 28 of axis X—X, shown on a larger scale in FIG. 3, is arranged in each opening 26.

The structure 28 of beam B extends radially from the edges of the openings of the portions 18*a*, 20*b* and is connected to such edge openings in a sealed manner.

At its internally radial periphery, the structure 28 is continued by radial members or radii 30 extending towards the path 8*a*.

The radii 30 support, by means of a ring 31, runners 32 in contact with the path 8*a* in order to be able to slide along the latter.

In the example shown in FIGS. 2 and 3, the hollow structure 28 comprises a first plate 34 and a second plate 36, the outer diameter of the first plate 34 being greater than the outer diameter of the second plate 36.

At the outer periphery of the first plate 34 there extends an outer collar 38 directed towards the second plate 36 and extending axially beyond the latter, thereby delimiting a passage 39 between the plate 36 and an internally radial face of collar 38.

An inner collar 40 is disposed at the externally radial periphery of the second plate 36 in such a manner as to be extended towards the outside of the hollow structure 28 in order to form, together with the outer collar 38, a communication conduit between the passage 39 of the hollow structure 28 and the adjacent beam A.

The inner collar 40 is fixed to the second plate 36 with the aid of a support 42.

The inner collar 40 has, on a face thereof facing which is opposite the outer collar 38, an inflatable bladder 44.

The bladder 44 has an inflating orifice connected to a hose 47 traversing the inner collar 40 and the second plate 36 in order then to extend inside the structure 28 as far as means, not shown, for inflating the bladder 44.

When the bladder 44 is inflated, as shown by the dashed lines in FIG. 3, the passage delimited between the outer collar 38 and the inner collar 40 is shut off in a sealed manner.

Furthermore, an extendable wall 46 extends between two successive structures 28.

The connection between the extendable wall 46 and each of the structures 28 is ensured in a sealed manner with the aid of fixing means 48 which are fixed to the outer face of each of the plates 34, 36 in the vicinity of the internally radial periphery thereof.

The extendable wall 46 delimits a conduit 50 for supplying the beams A, B, C, etc. with inflating fluid, this supply conduit surrounding the path 8*a*.

Thus, the structure 28, having its internally radial end open, brings the supply conduit 50 into communication with, for example, the beam A via the annular passage 39 which can be shut off by the bladder 44.

The plate 52 extends radially towards the outside of the structure 28 along the periphery of the outer collar 38.

Referring to FIG. 2, it can be seen that a rigid perforated ring 56 is arranged between the path 8*a* and the extendable wall 46.

The diameter of the rigid ring 56 is greater than the diameter of the internally radial periphery of the plates 34 and 36 such that, when the wall 46 is in its extended state, it has the shape of a bellows arranged between two structures 28 and ensuring the continuity of the supply conduit 50.

The rigid ring 56 is slidably mounted on the opening-out or folding-up path 8*a*.

The supply conduit 50 has a first end which is connected to means for supplying the beams A, B, C, etc. with inflating fluid.

The second end of the conduit 50 is closed.

Figure 5:
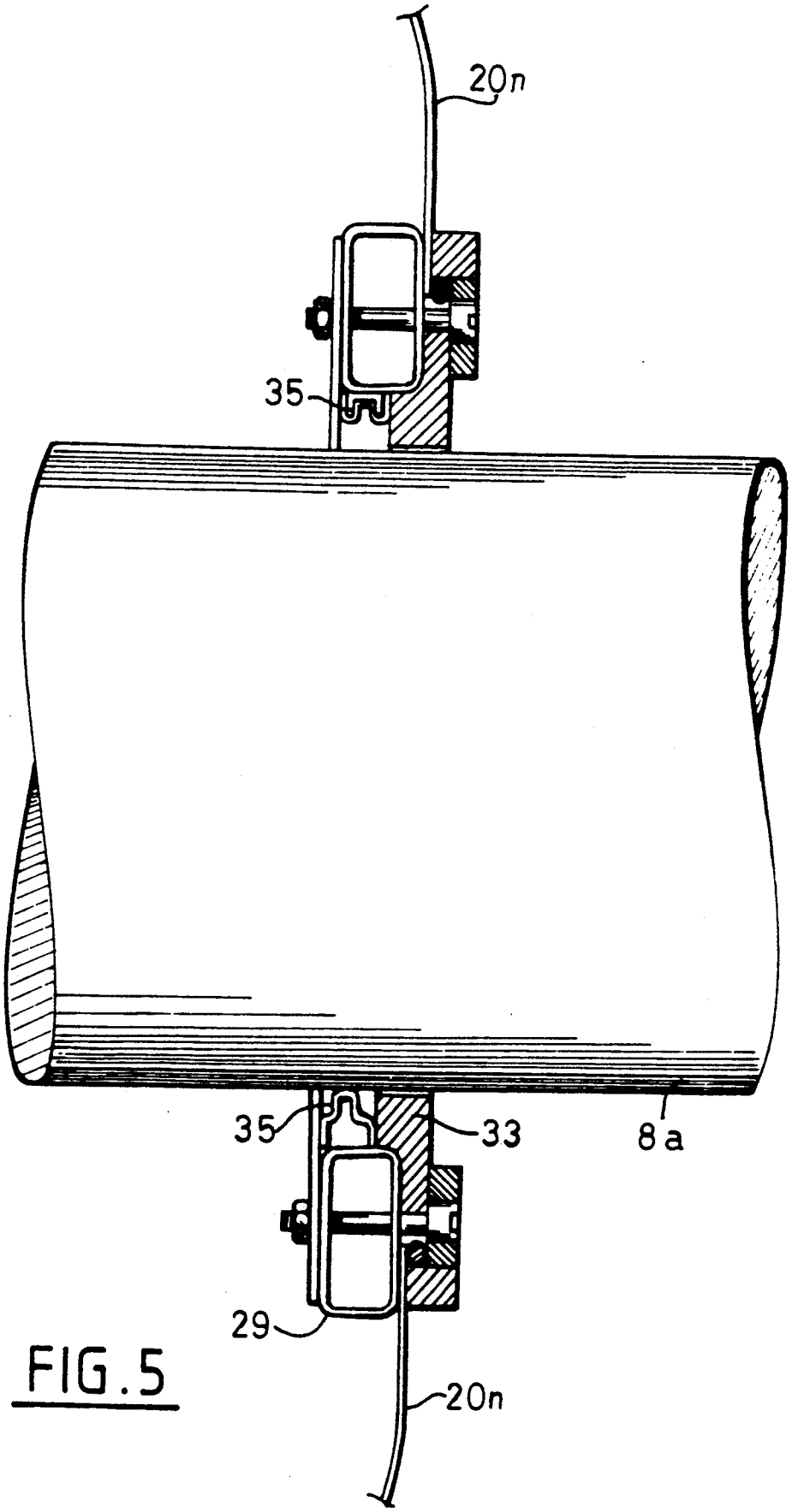
FIG. 5 is a diagrammatic sectional view showing one embodiment of means for sealing end beams of the vault with a opening-out path.

For this purpose and as shown in FIG. 5, the panel portion 20*n* of the end beam includes an annular structure 29 extending between the edge of the panel portion 20*n* and the path 8*a*.

This annular structure 29 comprises, at its internally radial periphery, on the one hand, an annular runner 33 surrounding the path 8*a* with a relatively small clearance in order to enable it to slide with a low loss of air compensated for by the flow rate of the inflating means and, on the other hand, an inflatable seal 35 which ensures optimum sealing between the annular structure 29 and the path 8*a* when the vault 2 is opened and the inflating means are stopped, in order to prevent any pressure loss from the corresponding beam and therefore from the entire vault 2.

In the case where the vault 2 is formed from beams A, B, C . . . M and N, which are not connected to each other, the edges of the panels of each beam are equipped with structures similar to that of FIG. 5 and each beam may be independently connected to inflating-fluid supply means.

In order to open the vault 2 shown in FIG. 1, pressurized air is passed into the conduit 50 through its first open end.

The bladder 44 of the end beam N furthest away from the inflating means is deflated and the bladders 44 of the other beams are inflated.

The pressurized air entering the conduit 50 traverses the various annular structures 28 and penetrates via the passage 39 into the last beam N which inflates.

When the pressure in the last beam N reaches a predetermined level, the associated bladder 44 is inflated in such a manner as to seal the last beam N.

Next, the corresponding bladder 44 of the penultimate beam M is deflated and the air provided by the inflating-fluid supply means then penetrates into such penultimate beam M which, in turn, is opened out and leads to the sliding of the associated hollow structure 28 and the associated radii 30 and runner 32 along a first portion of the path 8*a*.

The inflating of the vault continues until the various beams M . . . C, B, A have completely opened.

At this point, the seal 35 of the end beam N of the vault is inflated in order to ensure sealing with the path 8*a*.

In order to collapse the vault and to fold up the various beams, the bladders 44 are successively deflated in such a manner as to bring the various beams into communication with the supply conduit 50.

The air contained in the various beams is then sucked out through the supply conduit 50, leading to reverse-sliding and folding-up of the vault.

Figure 6:
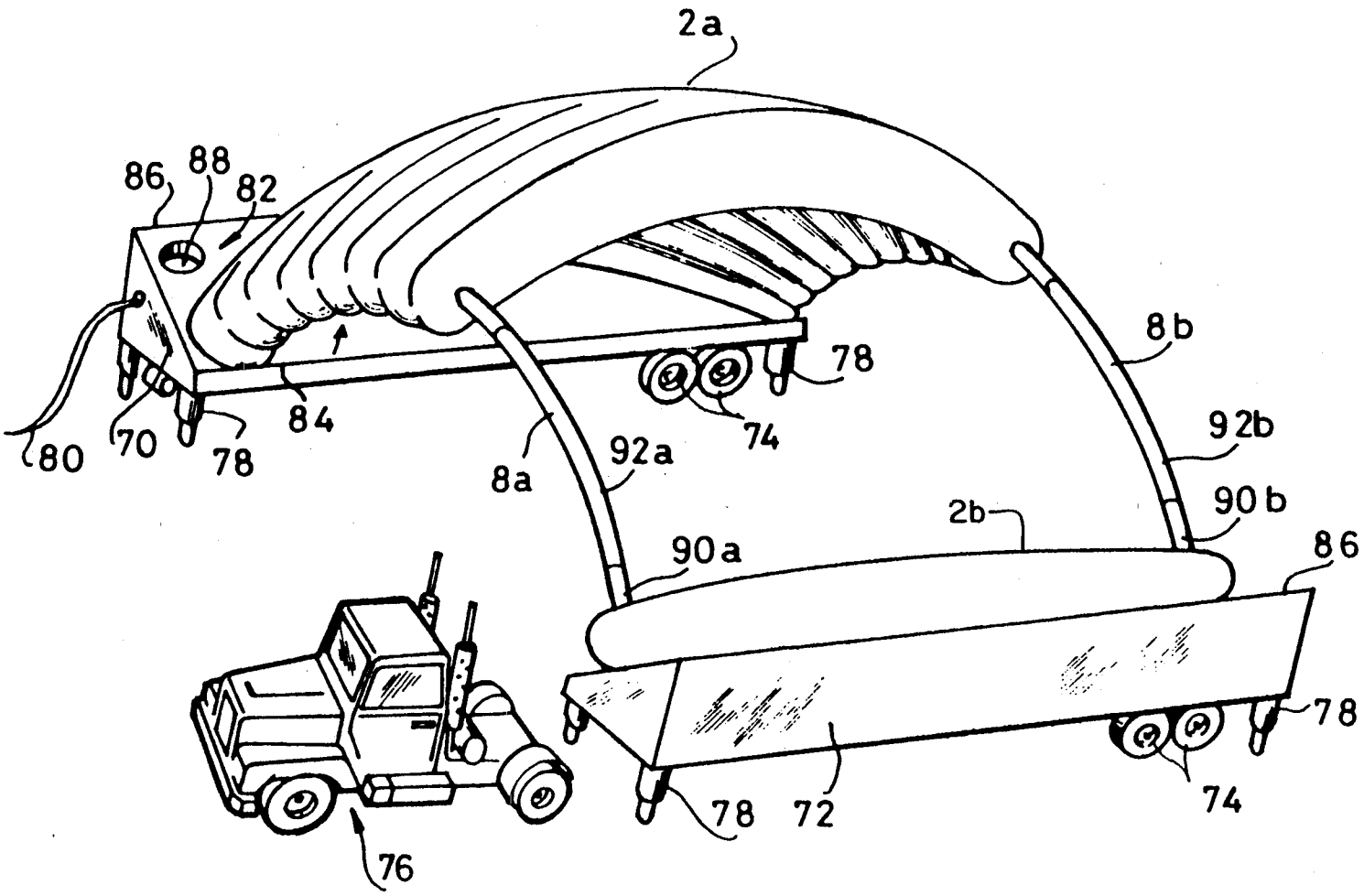
FIG. 6 is a perspective view of a vault according to the invention mounted on movable caissons.

FIG. 6 shows a vault according to the invention, consisting of two half-vaults 2*a*, 2*b*, one of which is shown opened and the other folded up.

The vault comprises two opening-out or folding-up paths 8*a*, 8*b*, the ends of which are fixed to movable caissons 70, 72 which are disposed in parallel.

The caissons 70, 72 comprise a rear axle fitted with a wheel set 74 and stabilising props 78 located at the lower corners of the caissons.

Each caisson comprises a hitch, not shown, in such a way as to be able to be towed by a towing vehicle 76.

The caissons are ballastable, for example with the aid of a pipe 80 for filling with water or with sand.

An upper face 82 of each caisson is inclined in relation to the vertical in such a manner that, when the caissons are in position, lower edges 84 of each face 82 are closer together than upper edges 86 of each face 82.

In the folded-up state, the half-vaults 2*a*, 2*b* rest on the faces 82.

The caissons 70, 72 also each comprise a device 88 for inflating the vault (only one of which is shown in FIG. 6), which device is connected to the supply conduit of the associated half-vault.

In order to facilitate the movement of the assembly, each path 8*a* or 8*b* is composed of two end sections 90*a* or 90*b* respectively, one of which is fixed to the caisson 70 and the other to the caisson 72, only the sections 90*a* and 90*b* fixed to the caisson 72 being visible in FIG. 6.

Each path 8*a*, 8*b* also comprises a central section 92*a*, 92*b* which can be dismounted when the two half-vaults 2*a*, 2*b* are folded up. In such a state, the end sections 90*a*, 90*b* possess a length greater than the thickness of a folded-up half-vault.

An installation has thus been produced which is easy to move and, as a result of the ballasting of the caissons, can withstand wind forces.

Reference will now be made to FIGS. 7 to 10 which show a vault according to the invention, intended to be permanently installed above an area to be covered.

It will be noted that the vault 2 consists of two half-vaults opening out towards each other along two paths 8*a*, 8*b* from ends thereof until reaching the middle of each of the paths.

Figure 7:
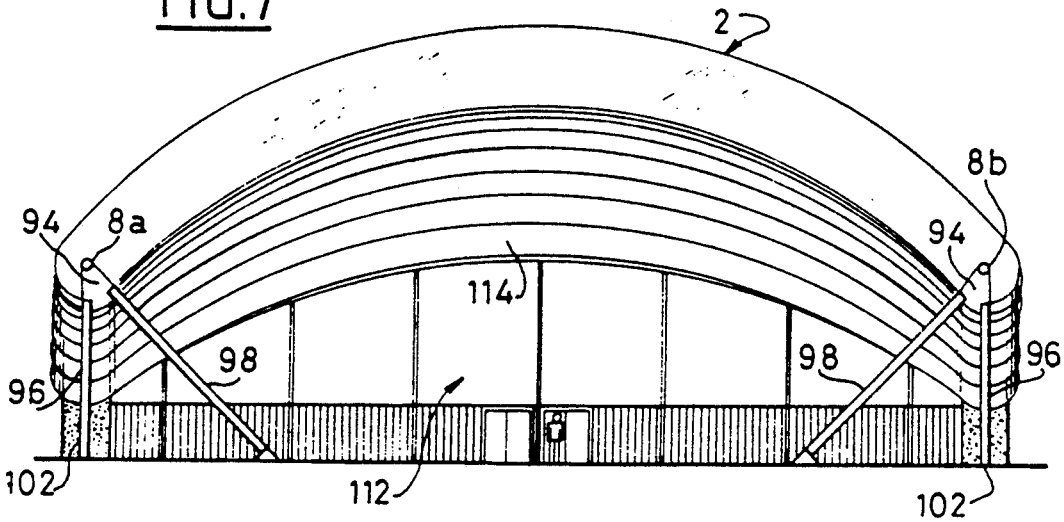
FIGS. 7 and 8 are views showing an installation comprising two half-vaults according to the invention and bracing means.
Figure 8:
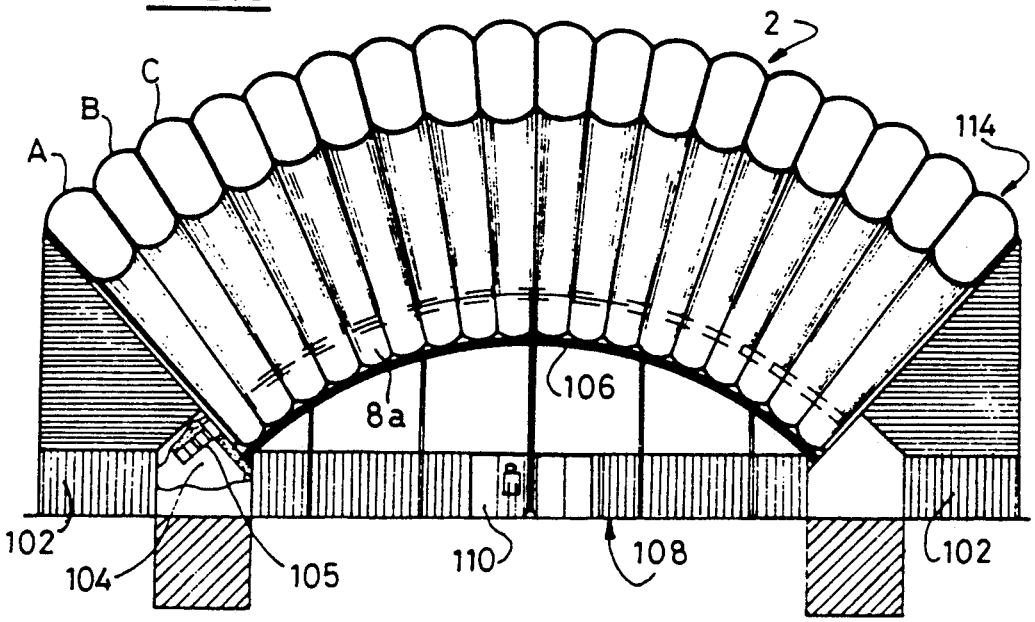

Each path 8*a*, 8*b* of the vault shown in FIGS. 7 and 8 comprises, at its middle, a fitting 94 extending vertically under the associated path and connected to the ground via at least one bracing member 96, 98 in order to ensure greater stability of the paths.

The ends of the paths 8*a*, 8*b* (FIG. 8) are fixed to abutments 102 anchored in the ground. Each abutment 102 comprises a chamber 104 in which the inflating-fluid supply means, for example a fan 105, is disposed.

An arch 106 whose ends are fixed to the abutments 102 extends parallel to each path 8*a*, 8*b* beneath the latter, a vertical partition 108 being arranged between the ground and the arch 106 and including access doors 110.

An inflatable seal, not shown, is arranged between the arch 106 and the ends of the beams A, B, C, etc. of the vault.

Figure 9:
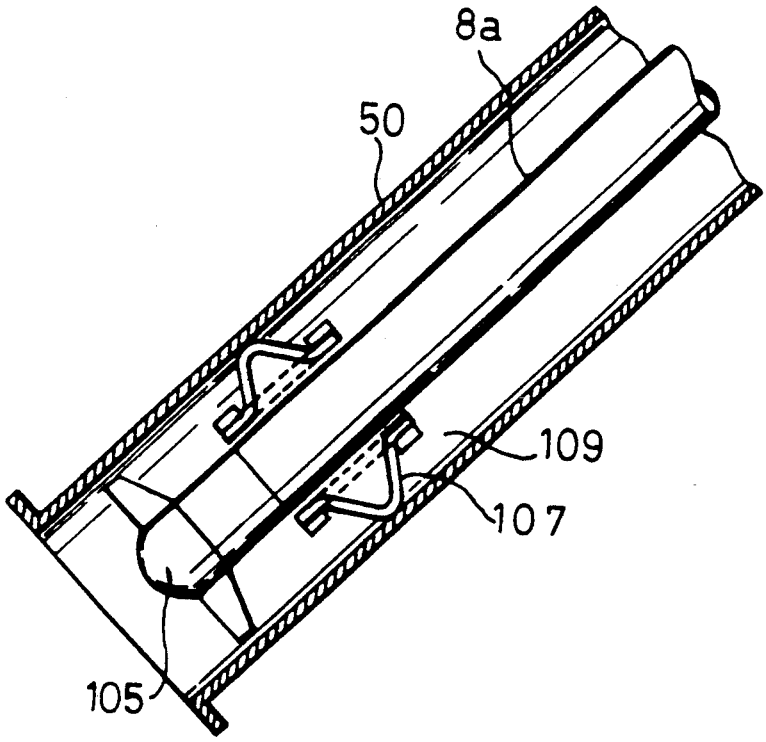
FIG. 9 is a detailed view of FIG. 8 showing the arrangement of an inflating-fluid supply means.

As shown in FIG. 9, the fan 105 is located in a continuation of the supply conduit 50 and of the opening-out or folding-up path 8*a*. An inflatable seal 107 is disposed in an annular space 109 between the supply conduit 50 and the path 8*a* in order to ensure sealing after inflating the vault.

Figure 10:
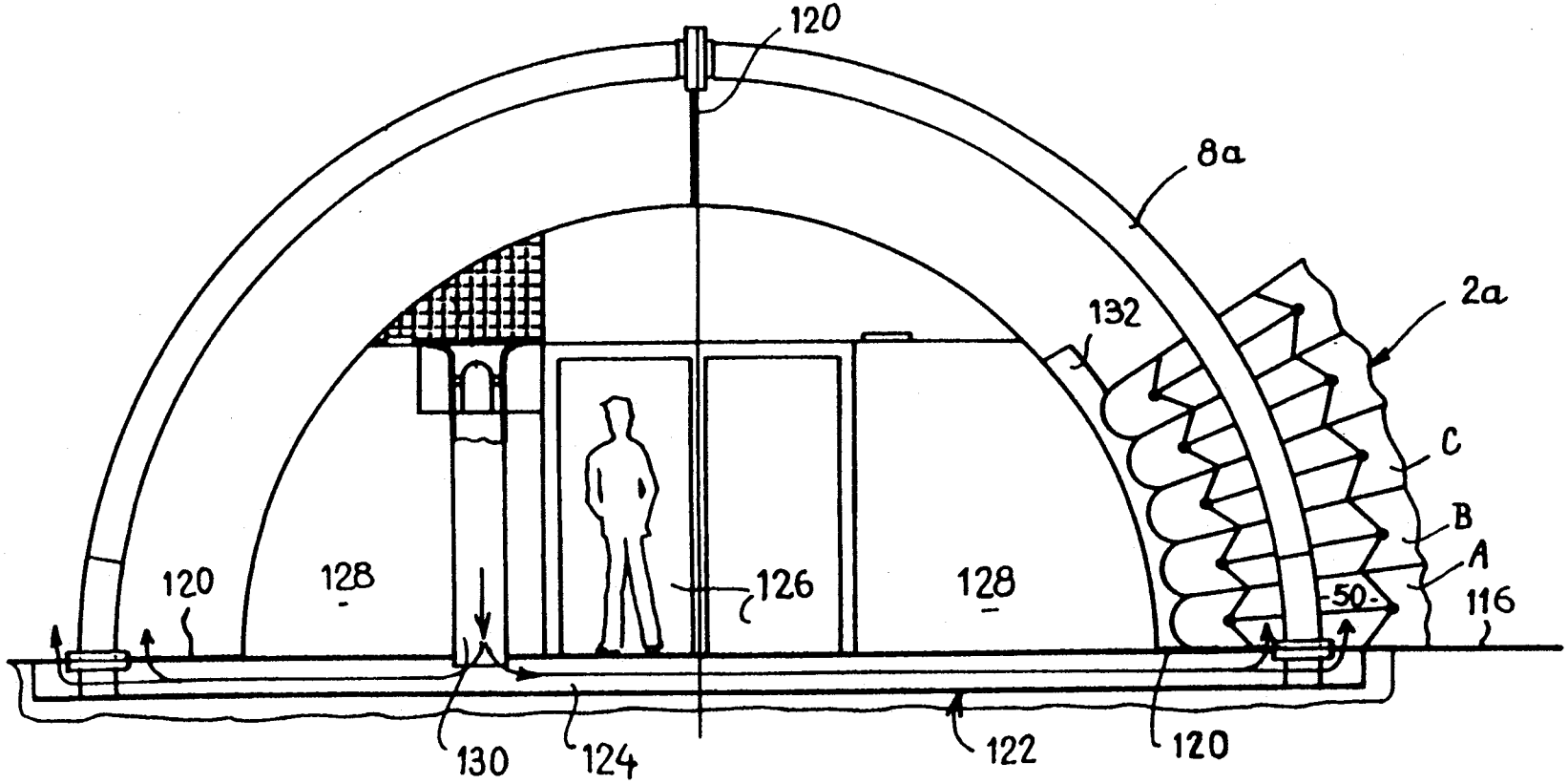
FIG. 10 is a view showing diagrammatically a vault according to the invention, consisting of two similar half-vaults, and comprising a caisson for closing one end of the vault.

FIG. 10 shows a partial view of a vault composed of two half-vaults, one 2*a* only of which is partially shown.

The half-vaults, in the folded-up state, rest on the ground 116 and comprise a beam in contact with the ground when they are opened out.

This arrangement enables each path 8*a*, 8*b* to be made in two symmetrical sections.

Each path 8*a*, 8*b* is connected via fittings 120, at the end and in the middle of the path 8*a*, 8*b*, to a caisson 122 extending under the path.

Each caisson 122 has a vertical crescent shape and the curvature of an upper wall of the caissans 122 is identical to the curvature of the paths 8*a*, 8*b*.

An inflatable seal 132 is disposed between the upper wall of each caisson 122 and the ends of the beams A, B, C, etc. located opposite one another.

The paths 8*a*, 8*b* are connected to each caisson 122 via fittings 120 and include a buried hollow base 124.

The caisson 122 has compartments constituting ballasting means 128, access doors 126 and an inflating-fluid supply conduit 130.

The inflating fluid follows a flow-path from the conduit 130 through the base 124 of the caisson 122 as far as the supply conduit 50 of each half-vault (see the arrows of FIG. 10).

Figure 11:
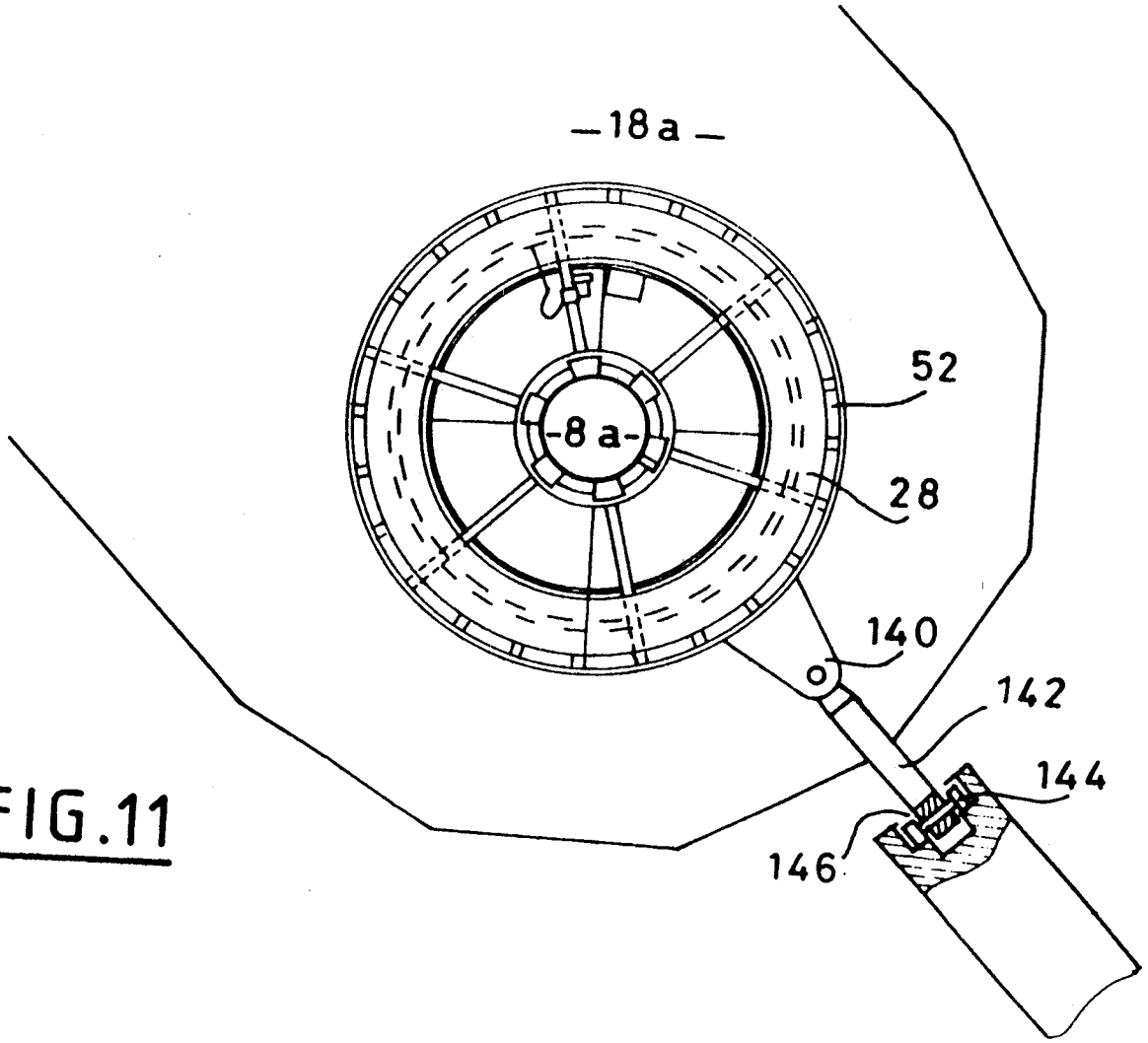
FIG. 11 is a diagrammatic sectional view of a second embodiment of the vault according to the invention.

According to an alternative form shown in FIG. 11, a fitting 140 is fixed to a zone of the periphery of the plate 52 which extends on the outside of the vault. The fitting 140 is connected to a member 142 for connection to a carriage 144 mounted so as to slide along a rail 146 arched in parallel with respect to the path 8*a*, 8*b*, the rail being anchored in the ground. The connecting member 142 is constituted by a bar or a cable.

An assembly is thus obtained having a greater resistance to the stresses transmitted by the vault.

The ends of the opening-out or folding-up paths may, in general, be embedded in the ground or articulated with respect to the ground.

I claim:

1. A multi-lobed, double-walled inflatable vault operable to be opened and collapsed by inflation and deflation, said vault comprising:

at least one member defining a path of opening and collapsing movement;

a plurality of longitudinal beams disposed side by side and mounted to be guided for sliding movement along said path defining member;

an inflating fluid supply connected to supply inflating fluid to said beams; and said path defining member extends entirely through each of the beams in a sealed manner.

2. A vault as claimed in claim 1, wherein said path defining member comprises an arched metal beam having a circular transverse cross section.

3. A vault as claimed in claim 1, wherein each said beam includes an inflatable member for sealing with said path defining member when said vault has been opened.

4. A vault as claimed in claim 1, wherein each said beam comprises a panel including a portion forming flanges of said beam and a portion forming a web of said beam, said inflating fluid supply comprises at least one fluid supply conduit extending sealingly through openings in said panels of all of said beams, said fluid supply conduit is of extendable length and operable to be extended and retracted upon opening and collapsing movement of said beams, said fluid supply conduit is in fluid communication with said beams via respective orifices that are controllable and closable by respective inflatable seals, said path defining member extends longitudinally inside said fluid supply conduit, and sliding members guiding sliding movement of said beams along said path defining member are located between said path defining member and a wall of said fluid supply conduit.

5. A vault as claimed in claim 4, wherein each of said sliding members is located in said openings of adjacent said panels of successive said beams.

6. A vault as claimed in claim 5, wherein each said sliding member comprises a runner to slide along said path defining member, said runner is supported by radial members extending transversely to said path defining member and supported radially outwardly by an annular hollow structure that is coaxial of said path defining member, said annular hollow member has a radially outer periphery sealingly connected to edges of said adjacent panels defining said openings, said annular hollow structure is open to the interior of said fluid supply conduit and in fluid communications with the interior of a successive said beam via the respective said orifice.

7. A vault as claimed in claim 6, wherein each said annular hollow structure comprises an outer collar and an inner collar defining therebetween an annular passage forming said respective orifice, and said inflatable seal comprises an inflatable and flattenable bladder supported by said inner collar and operable when inflated to sealingly contact said outer collar.

8. A vault as claimed in claim 6, wherein said fluid supply conduit is defined by extendable walls sealingly fixed to adjacent annular hollow members of adjacent beams.

9. A vault as claimed in claim 8, further comprising a plurality of rigid rings slidably mounted on said path defining member and extending outwardly therefrom to respective said extendable walls.

10. A vault as claimed in claim 6, further comprising a plate extending radially outwardly from each said annular hollow structure and sealingly fixed to adjacent said panels of adjacent said beams.

11. A vault as claimed in claim 10, further comprising a fitting fixed to said plate at a periphery therof and extending outwardly of said vault, and a member connected to said fitting and connected to a carriage slidable along a rail to be anchored in the ground and having an arched configuration extending parallel to said path defining member.

12. A vault as claimed in claim 1, comprising two half-vault arrangements of said longitudinal beams and mounted on said at least one path defining member to be inflated and opened toward one another from respective ends of said at least one path defining member and to be deflated and collapsed away from one another toward said respective ends of said at least one path defining member.

13. A vault as claimed in claim 1, comprising tow parallel said path defining members, each located at respective opposite longitudinal ends of said beams.

14. A vault as claimed in claim 13, wherein said respective ends of each said path defining member are fixed to respective ballastable movable caissons.

15. A vault as claimed in claim 13, wherein each said path defining member comprises two end portions fixed to respective caissons and a removable center portion fixed between said end portions, each said end portion being surrounded by longitudinal ends of said longitudinal beams when collapsed.

16. A vault as claimed in claim 13, wherein opposite ends of each said path defining member are fixed to respective abutment structures anchored to the ground.

17. A vault as claimed in claim 13, wherein each said path defining member includes a central portion having a fitting supported from the ground by a brace.

18. A vault as claimed in claim 13, wherein each said path defining member is arched and has at central and opposite end portions thereof fittings connected to an upwardly arched caisson positioned beneath said path defining member and extending vertically parallel thereto.

19. A vault as claimed in claim 18, further comprising, for each said path defining member, an inflatable seal disposed between opposite ends of said path defining member and on an upper surface of the respective said caisson.

20. A vault as claimed in claim 18, wherein each said caisson includes an inflating fluid supply inlet, ballast, and a portion defining an access door beneath said vault.

21. A vault as claimed in claim 1, wherein said inflating fluid supply comprises a fluid supply conduit extending sealingly through said beams, said path defining member extending through said fluid supply conduit, and further comprising a fluid inlet in the form of a continuation of said fluid supply conduit, and an inflatable seal for sealing between said path defining member and said continuation after inflation of said vault.

* * * * *